US008912992B2

(12) United States Patent
Ochiai et al.

(10) Patent No.: US 8,912,992 B2
(45) Date of Patent: Dec. 16, 2014

(54) DISPLAY DEVICE

(75) Inventors: Takahiro Ochiai, Chiba (JP); Mitsuru Goto, Chiba (JP); Hiroyuki Higashijima, Konosu (JP); Motoharu Miyamoto, Mobara (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 13/437,038

(22) Filed: Apr. 2, 2012

(65) Prior Publication Data

US 2012/0262441 A1 Oct. 18, 2012

(30) Foreign Application Priority Data

Apr. 15, 2011 (JP) ..... 2011-091156

(51) Int. Cl.
*G09G 3/36* (2006.01)

(52) U.S. Cl.
CPC ..... *G09G 3/3677* (2013.01); *G09G 2310/0205* (2013.01); *G09G 2310/08* (2013.01)
USPC ..... 345/87; 345/100; 345/212; 345/173

(58) Field of Classification Search
CPC ..... G09G 2310/0205; G09G 2310/08; G09G 3/3677
USPC ..... 345/87, 100, 173–183, 212
See application file for complete search history.

(56) References Cited

U.S. PATENT DOCUMENTS

| | | | | |
|---|---|---|---|---|
| 2003/0222838 | A1* | 12/2003 | Iida et al. | 345/87 |
| 2006/0221040 | A1 | 10/2006 | Pak et al. | |
| 2007/0070020 | A1* | 3/2007 | Edo et al. | 345/100 |
| 2010/0007653 | A1 | 1/2010 | Ahn et al. | |

FOREIGN PATENT DOCUMENTS

| | | |
|---|---|---|
| JP | 10-39325 | 2/1998 |
| JP | 2003-344824 | 12/2003 |
| JP | 2006-285233 | 10/2006 |
| JP | 2010-20282 | 1/2010 |

* cited by examiner

*Primary Examiner* — Jason Olson
*Assistant Examiner* — Insa Sadio
(74) *Attorney, Agent, or Firm* — Antonelli, Terry, Stout & Kraus, LLP.

(57) ABSTRACT

A display device includes a driving circuit that applies an active potential which is a potential for turning on pixel transistors sequentially to a plurality of output signal lines, wherein the driving circuit includes a main driving circuit that outputs the active potential to one end of the output signal line of the plurality of output signal lines by applying a clock signal caused by a input of the active potential output from the upper output signal line, and an auxiliary driving circuit that has an auxiliary transistor which is a transistor where the other end of the output signal line is connected to a signal line for the clock signal via the source or the drain. Thereby, output waveform distortion in the scanning signal line can be improved and thus display quality can be enhanced.

9 Claims, 19 Drawing Sheets

DISPLAY DEVICE

CROSS-REFERENCE TO RELATED APPLICATION

The present application claims priority from Japanese application JP2011-091156 filed on Apr. 15, 2011, the content of which is hereby incorporated by reference into this application.

BACKGROUND OF THE INVENTION

1. Field of the Invention

The present invention relates to a display device.

2. Description of the Related Art

As display devices for information communication terminals such as a computer or television receivers, liquid crystal display devices have been widely used. In addition, organic EL display devices (OLEDs), field emission display devices (FEDs), and the like are known as thin display devices.

The liquid crystal display device is a device in which alignment of liquid crystal composition sealed between two substrates is altered by changing an electric field, and images are displayed by controlling the transmissive extent of light passing through the two substrates and the liquid crystal composition.

In display devices which include such a liquid crystal display device and apply a voltage corresponding to a predetermined grayscale value to each pixel in the screen, a pixel transistor for applying a voltage corresponding to a grayscale value to each pixel is disposed. Generally, gates of pixel transistors for one line of the screen are connected to a single signal line (hereinafter, referred to as a "scanning signal line"), and the scanning signal line is controlled by a driving circuit so as to sequentially output an active voltage for turning on the pixel transistors line by line.

JP2010-020282A discloses an example of the driving circuit for improving output characteristics to the scanning signal lines. JP2006-285233A discloses an example of the driving circuit for reducing a circuit scale. JP2003-344824A and JP10-039325A disclose an example where an auxiliary circuit (terminator) is provided at an opposite side to a driving circuit of the scanning signal lines in order to improve waveform distortion of the scanning signal.

SUMMARY OF THE INVENTION

For example, in the circuit of FIG. 1 disclosed in JP2010-020282A, a transistor NT15 for maintaining a potential of the scanning signal line at a low level is not activated until an output of the scanning signal line in the next stage becomes a high level, thus falling of the signal of the scanning signal line is delayed, and thereby waveform distortion substantially remains. In addition, in a circuit of FIGS. 3 and 4 disclosed in JP2006-285233A, since a clock signal is applied to a gate of the transistor RT3 (LT3), if the circuit is operated for a long time, a threshold value voltage shifts considerably, and thus a function of maintaining the scanning signal line at a low level is notably deteriorated. These phenomena cause a variation in the grayscale voltage which is to be maintained in each pixel, and thus display quality of the display device is deteriorated.

The present invention has been made in consideration of the circumstances described above, and an object thereof is to improve output waveform distortion of scanning signal lines in a driving circuit of the scanning signal lines of the display device and to thereby improve display quality of a display device.

According to an aspect of the present invention, there is provided a display device including a driving circuit that sequentially applies an active potential which is a potential for turning on pixel transistors to a plurality of output signal lines from a upper output signal line to a lower output signal line, wherein the driving circuit includes a main driving circuit that outputs the active potential to one end of a output signal line of the plurality of output signal lines by applying a clock signal caused by a input of the active potential output from the upper output signal line; and an auxiliary driving circuit that has an auxiliary transistor which is a transistor in which one of a source and a drain is connected to the other end of the output signal line, and the other is connected to a signal line for the clock signal.

In addition, in the display device according to the aspect of the present invention, the output signal line may be connected to either the source or the drain and a gate of the auxiliary transistor, that is, may be diode-connected thereto.

In the display device according to the aspect of the present invention, the main driving circuit may further include a main transistor that is a switch to apply the clock signal to the output signal line, and the gate of the auxiliary transistor may be connected to a gate line of the main transistor for the upper output signal line.

In the display device according to the aspect of the present invention, the main driving circuit may further include a main transistor that is a switch to apply the clock signal to the output signal line, and the gate of the auxiliary transistor may be connected to a gate line of the main transistor for the lower output signal line.

DETAILED DESCRIPTION OF THE INVENTION

Figure 1:
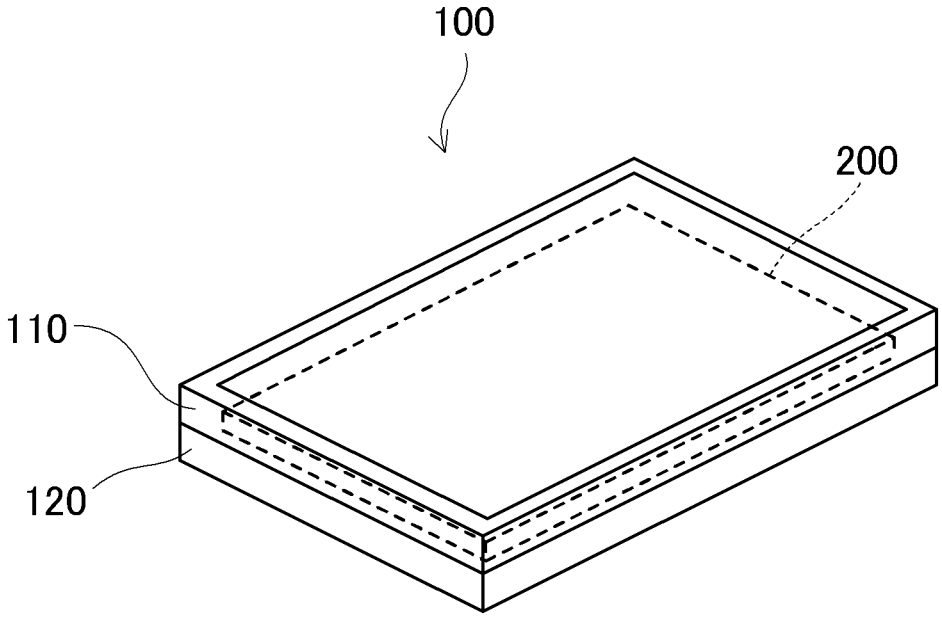
FIG. 1 is a diagram schematically illustrating a liquid crystal display device according to an embodiment of the present invention.

Hereinafter, first to fourth embodiments of the present invention will be described with reference to the drawings. In the drawings, the same or equivalent elements are given the same reference numerals, and repeated description will be omitted.

[First Embodiment]

FIG. 1 schematically shows a liquid crystal display device 100 according to an embodiment of the present invention. As shown in FIG. 1, the liquid crystal display device 100 includes a liquid crystal panel 200 which is fixed in place between an upper frame 110 and a lower frame 120, a backlight device (not shown), and the like.

Figure 2:
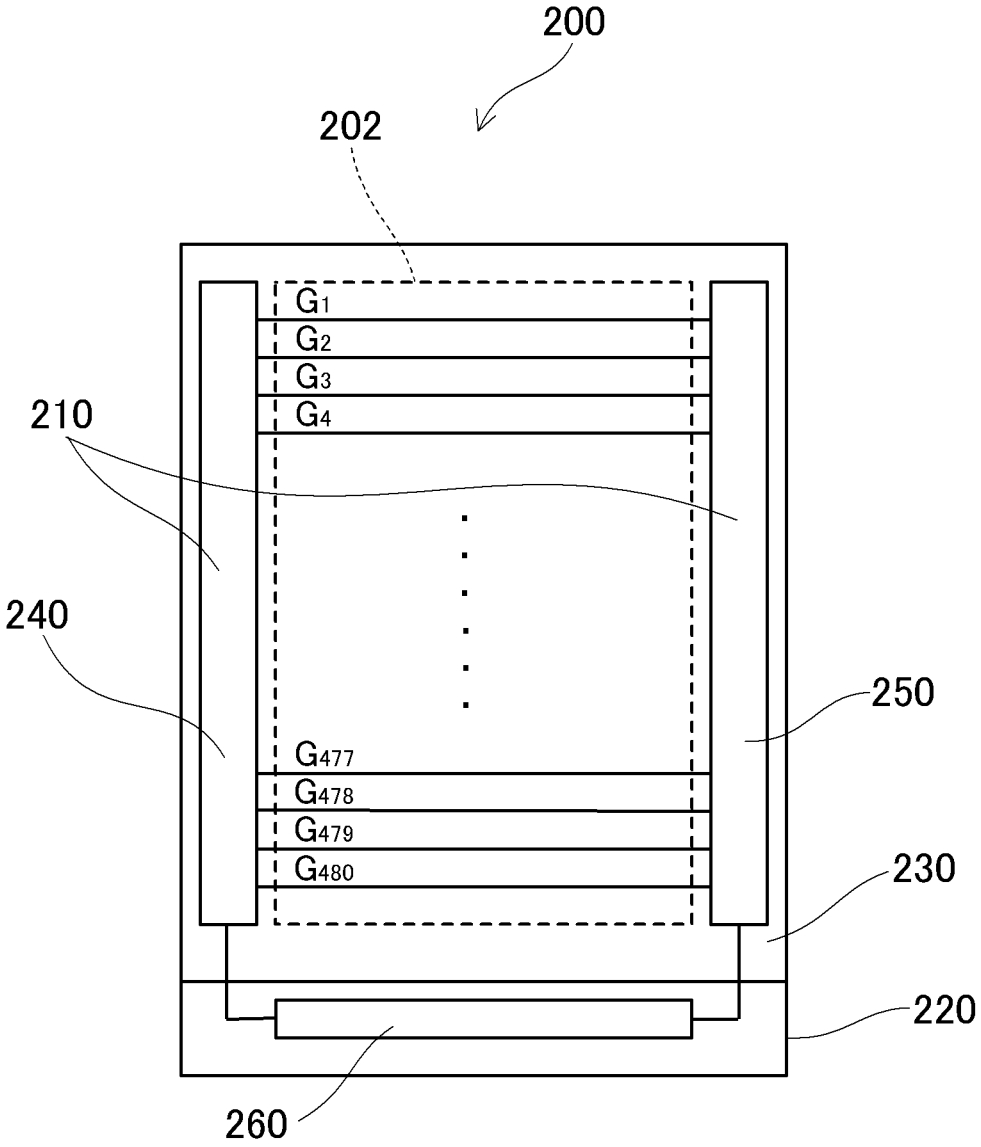
FIG. 2 is a diagram illustrating a liquid crystal panel of a liquid crystal display device according to a first embodiment.

FIG. 2 shows a configuration of the liquid crystal panel 200 shown in FIG. 1. The liquid crystal panel 200 includes two substrates of a TFT (Thin Film Transistor) substrate 220 and a color filter substrate 230, and liquid crystal composition is sealed between the two substrates. The TFT substrate 220 includes a driving circuit 210 which sequentially applies predetermined voltages to scanning signal lines G1 to G480, and a driving IC (Integrated Circuit) 260 which applies voltages corresponding to grayscale values of pixels to a plurality of data signal lines (not shown) which extend so as to perpendicularly intersect the scanning signal lines G1 to G480 in a pixel region 202 and controls the driving circuit 210. Here, the driving circuit 210 has a main driving circuit 240, and an auxiliary driving circuit 250 which is connected at the opposite end of the scanning signal lines G1 to G480 against the end to which the main driving circuit 240 is connected.

Figure 3:
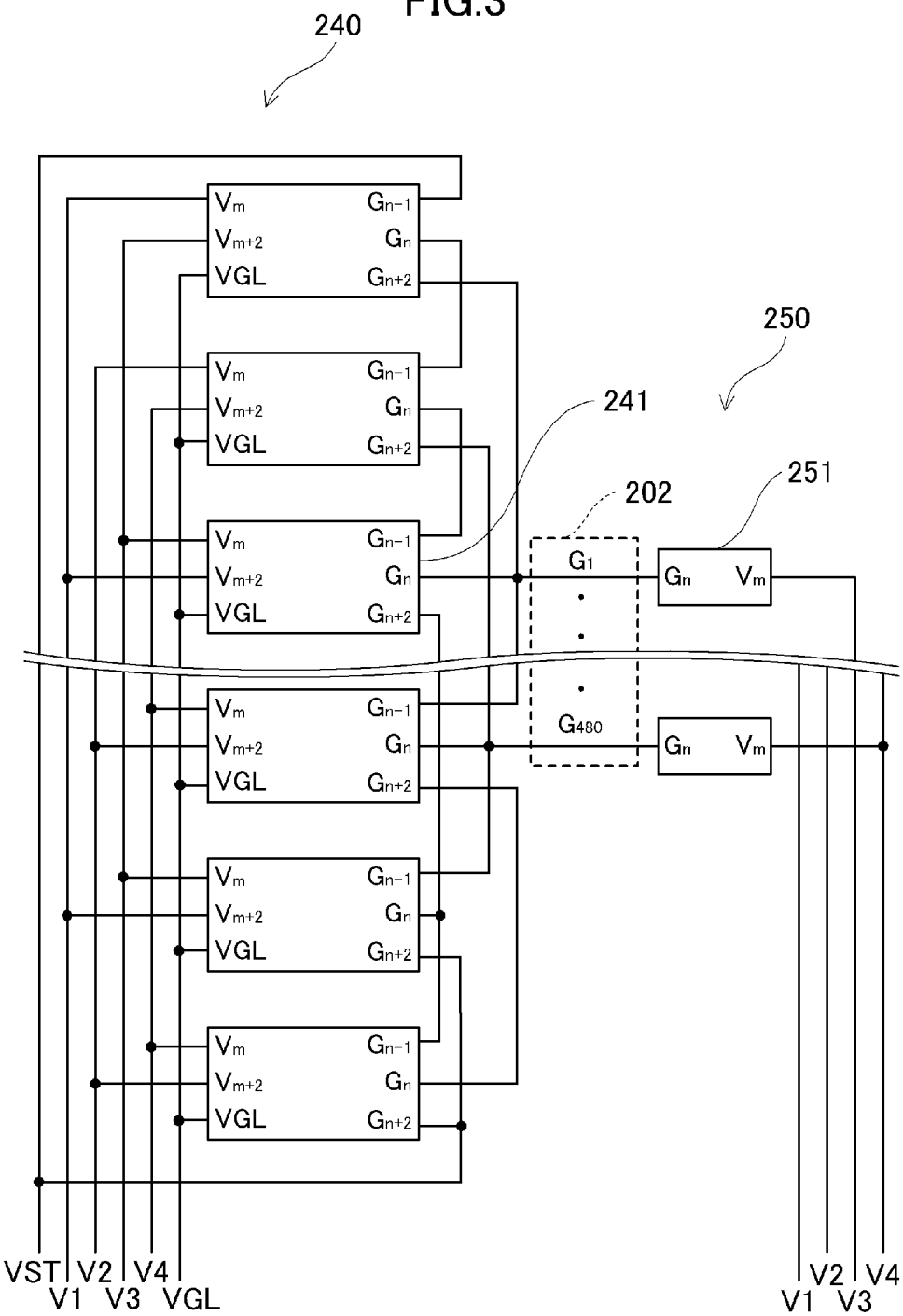
FIG. 3 is a schematic diagram illustrating the main driving circuit and the auxiliary driving circuit shown in FIG. 2.

FIG. 3 schematically shows details of the main driving circuit 240 and the auxiliary driving circuit 250. As shown in FIG. 3, the main driving circuit 240 is formed from a plurality of signal output circuits 241, and each of the signal output circuits 241 has a single output terminal Gn. The output terminal Gn of the signal output circuit 241 is input to an input terminal Gn−1 of the next signal output circuit 241 which is the signal output circuit 241 of next stage, and the signal output circuits 241 sequentially output high level signals. In addition, the signal output circuits 241 in two stages from the top and the signal output circuits 241 in two stages from the bottom are dummy circuits, and are connected to input and output signal lines of the signal output circuits 241 which output signals to the upper scanning signal lines G1 and G2 and the lower scanning signal lines G479 and G480. In addition, the auxiliary driving circuit 250 disposed at an opposite side to the signal output circuits 241 via the scanning signal lines G1 to G480 includes auxiliary circuits 251 corresponding to the signal output circuits 241 excluding the dummy circuits.

Figure 4:
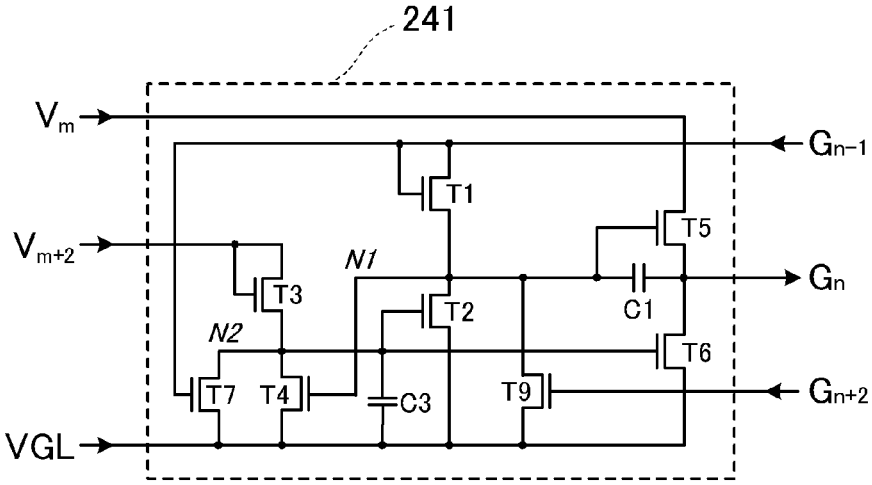
FIG. 4 is a diagram illustrating a circuit configuration of the signal output circuit shown in FIG. 3.
Figure 5:
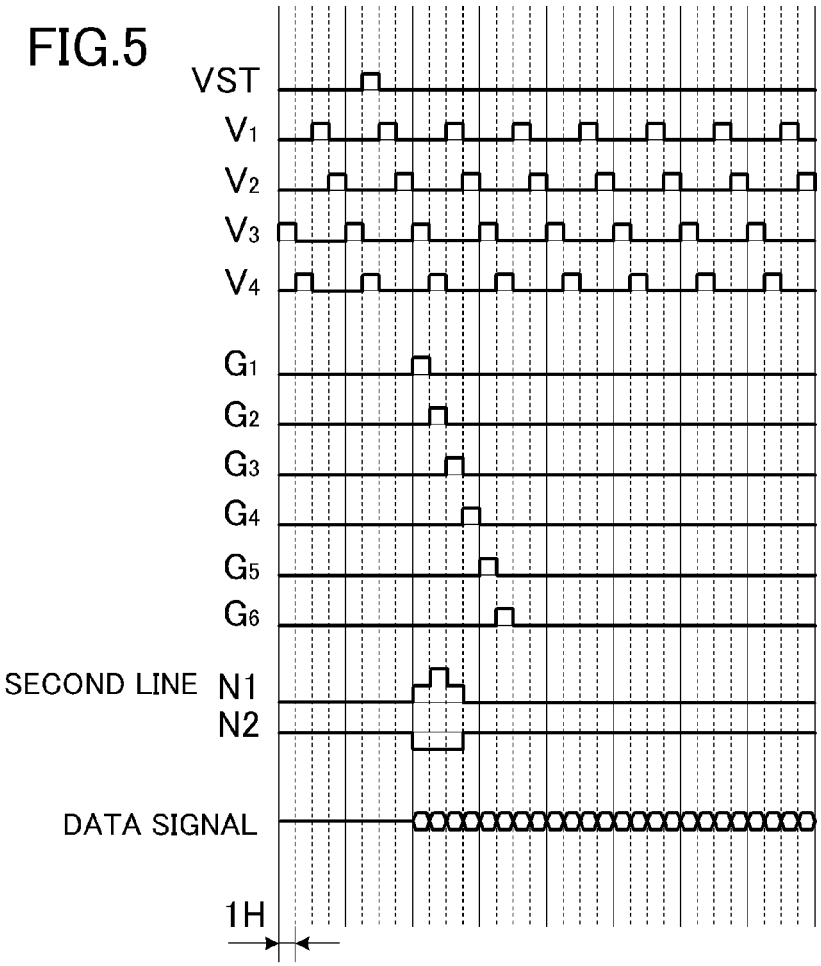
FIG. 5 is a timing chart for an operation of the signal output circuit shown in FIG. 4.

FIG. 4 is a diagram illustrating a circuit configuration of the signal output circuit 241, and FIG. 5 is a timing chart for an operation of the signal output circuit 241 shown in FIG. 4. An operation of the signal output circuit 241 will be described. Here, V1 to V4 indicate clock signals, VST indicates a start signal, and a potential of a terminal VGL is fixed to a low level. The signals are all input from an external device of the signal output circuit 241. In FIG. 4, a case of n=2 and m=4 will be described as an example. First, if an output G1 becomes a high level, the output G1 is input to an input terminal Gn−1 in FIG. 4, and thus a gate of a transistor T7 becomes a high level. Then, the transistor T7 is turned on, and thus a node N2 is connected to the terminal VGL so as to become a low level. In addition, the output G1 is also input to a diode-connected transistor T1, and thus a node N1 connected thereto becomes a high level, thereby causing a potential difference in a capacitor C1 and turning on a transistor T5. The node N1 is connected to a gate of a transistor T4, and the node N2 is connected to the terminal VGL by the transistor T4 and becomes a low level.

Next, if the clock signal V4 becomes a high level, since the transistor T5 is on, a potential of one electrode of the capacitor C1 becomes a high level, and thus a gate potential of the transistor T5 which is the other side of the electrode of the capacitor C1 can be pushed up by a so-called bootstrap. Thereby, the output G2 is fixed to a high level. A data signal voltage based on a grayscale value of each pixel is applied to the data signal lines (not shown) during a writing period when the output G2 is at a high level, and the applied voltage based on the grayscale value is maintained in the pixel by falling of the output G2 described later.

If the clock signal V4 becomes a low level, the output G2 also becomes a low level. In order to maintain the low level of the output G2, the clock signal V2 that is at a high level is input to the diode-connected transistor T3 such that the node N2 becomes a high level, in turn the transistor T6 which has a gate that is connected to the node N2 that is at a high level connects the output G2 and VGL and sets the output G2 at a low level. On the other hand, an output G4 that is at a high level is input to a gate of a transistor T9 after two horizontal driving periods, and thus the node N1 is connected to VGL such that the node N1 becomes a low level.

Figure 6:
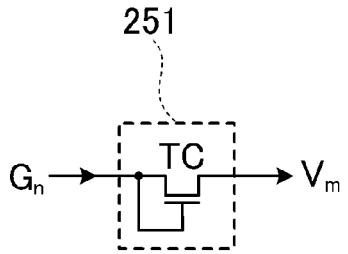
FIG. 6 is a diagram a circuit configuration of the auxiliary circuit shown in FIG. 3.

FIG. 6 is a diagram illustrating a circuit configuration of the auxiliary circuit 251. As shown in FIG. 6, the auxiliary circuit 251 has a single transistor TC, a scanning signal line Gn is diode-connected to the transistor TC, and a line for a corresponding clock signal Vm is connected to the scanning signal line Gn.

Thereby, at a time when the scanning signal line Gn changes from a high level to a low level in response to the clock signal Vm, the transistor TC is turned on when the scanning signal line Gn is at a high level due to a response delay even if the clock signal Vm is at a low level. Therefore, a current is leaked from the scanning signal line Gn in a high level to the line for the clock signal Vm in a low level, thus falling of the scanning signal line Gn becomes faster, and thereby waveform distortion can be improved. In addition, since a signal of the scanning signal line Gn input to the transistor TC is kept at a low level during entire period other than the output period, and since the clock signal Vm is an alternate current signal, it is possible to suppress shift of the threshold value voltage Vth caused by applying a high potential for a long time.

Therefore, it is possible to improve distortion of waveform output from the driving circuit of the liquid crystal display device, and thus display quality of the display device can be enhanced.

[Second Embodiment]

The second embodiment of the present invention will be described. A configuration of the liquid crystal display device according to the second embodiment is the same as the configuration according to the first embodiment shown in FIG. 1, and thus a redundant description will be omitted.

Figure 7:
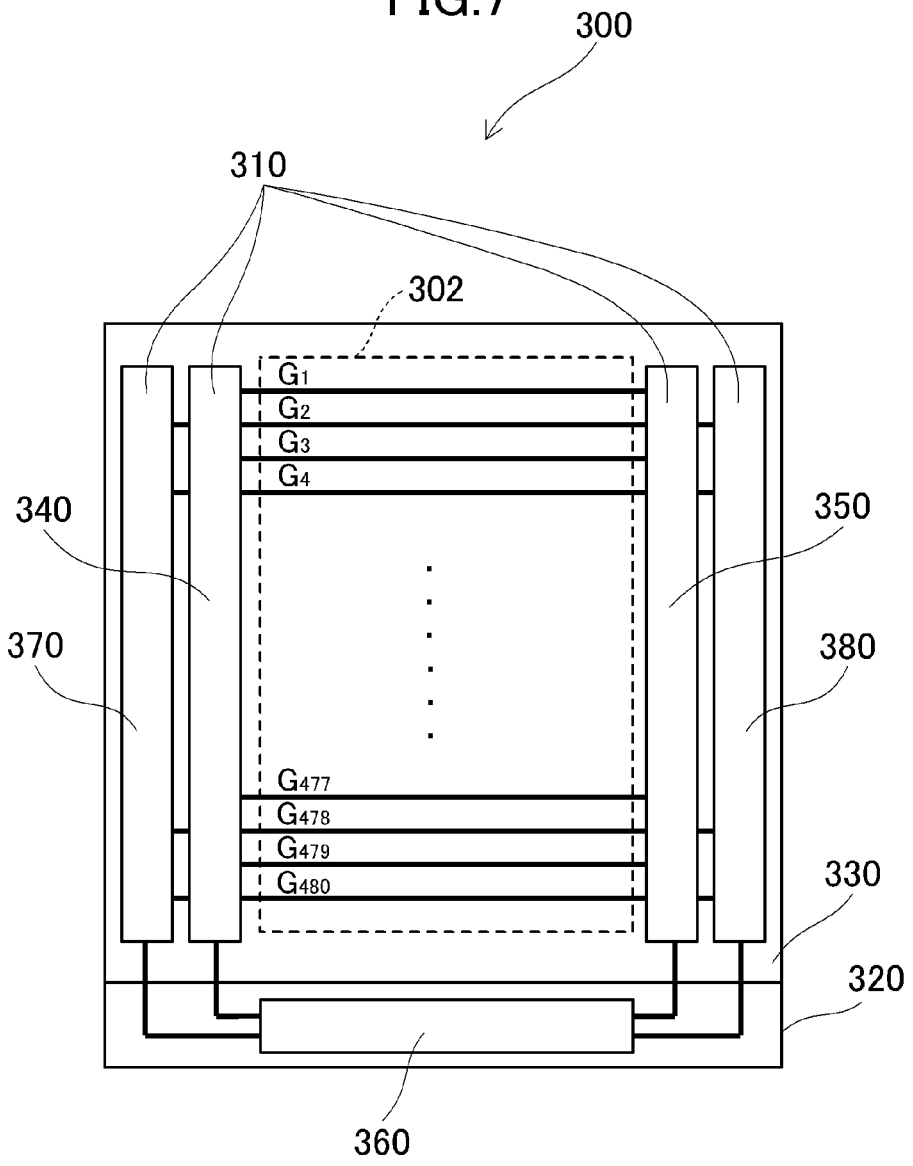
FIG. 7 is a diagram illustrating a liquid crystal panel of a liquid crystal display device according to a second embodiment.

FIG. 7 shows a liquid crystal panel 300 of the liquid crystal display device according to the second embodiment. The liquid crystal panel 300 includes two substrates of a TFT substrate 320 and a color filter substrate 330, and liquid crystal composition is sealed between the two substrates. The TFT substrate 320 includes a driving circuit 310 which sequentially applies predetermined voltages to scanning signal lines G1 to G480, and a driving IC 360 which applies voltages corresponding to grayscale values of pixels to a plurality of data signal lines (not shown) which extend so as to perpendicularly intersect the scanning signal lines G1 to G480 in a pixel region 302 and controls a first main driving circuit 340 and a second main driving circuit 370. In addition, the driving circuit 310 includes the first main driving circuit 340 which sequentially applies predetermined voltages to odd numbered scanning signal lines G2*i*-1 (where i is 1 to 240), the second main driving circuit 370 which sequentially applies predetermined voltages to even numbered scanning signal lines G2*i*, a first auxiliary driving circuit 350 which is connected at the opposite end of the scanning signal lines G2*i*-1 against the end to which the first main driving circuit 340 is connected, and a second auxiliary driving circuit 380 which is connected at the opposite end of the scanning signal lines G2*i* against the end to which the second main driving circuit 370 is connected.

Figure 8:
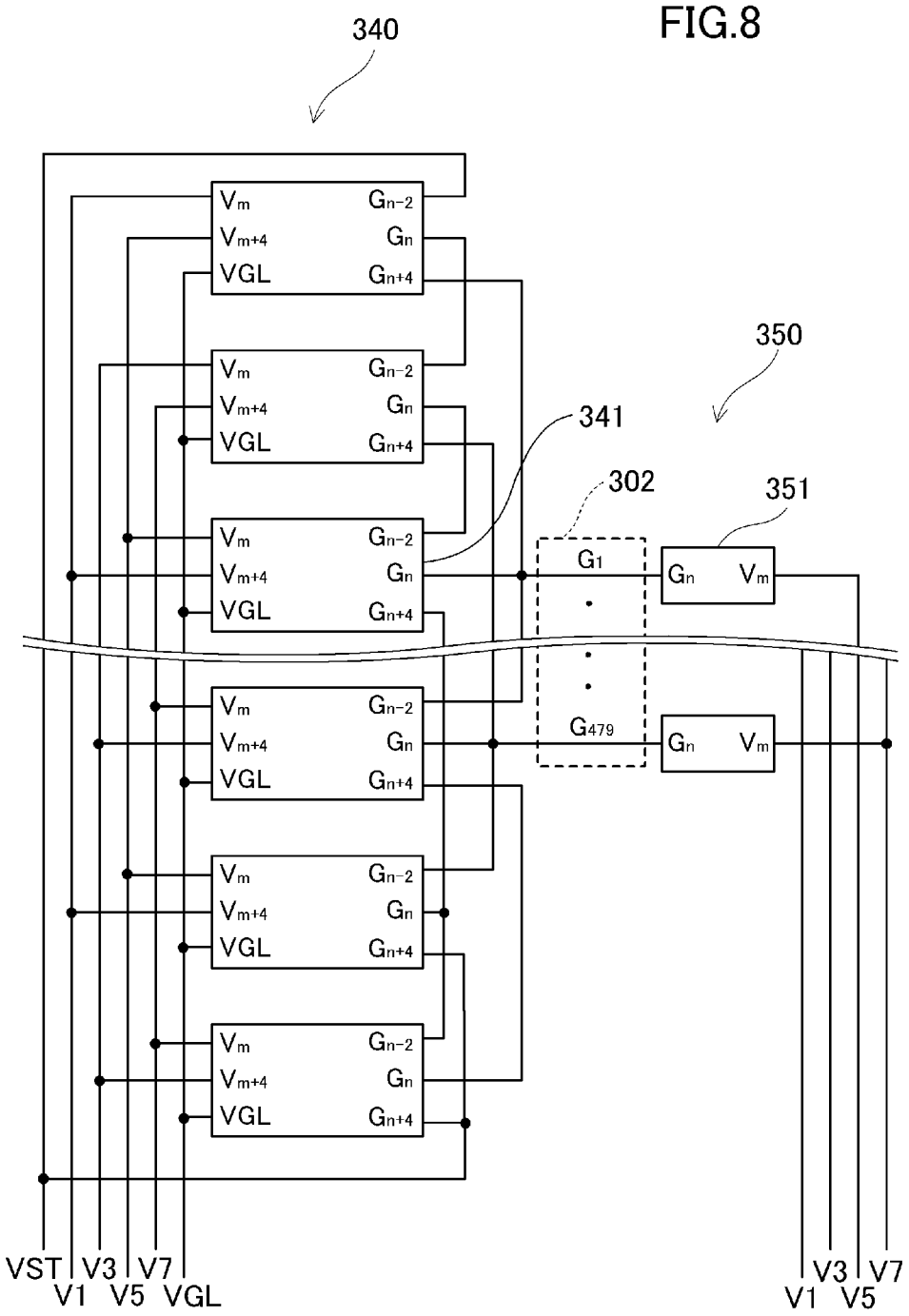
FIG. 8 is a diagram schematically illustrating the first driving circuit and the first auxiliary driving circuit shown in FIG. 7.

FIG. 8 schematically shows details of the first main driving circuit 340 and the first auxiliary driving circuit 350. A configuration of the first main driving circuit 340 and the first auxiliary driving circuit 350 is the same as that of the main driving circuit 240 and the auxiliary driving circuit 250 shown in FIG. 3 except that they correspond to only the odd numbered scanning signal lines G2*i*-1. The first main driving circuit 340 includes a plurality of signal output circuits 341, and each of the signal output circuits 341 has a single output terminal Gn. The output terminal Gn of the signal output circuit 341 is input to an input terminal Gn−2 of the next signal output circuit 341, and the signal output circuits 341 sequentially output a high level signal. In addition, the signal output circuits 341 in two stages from the top and the signal output circuits 341 in two stages from the bottom are dummy circuits, and are connected to input and output signal lines of the signal output circuits 341 which output signals to the upper scanning signal lines G1 and G3 and the lower scanning signal lines G477 and G479. In addition, the first auxiliary driving circuit 350 disposed at an opposite side to the signal output circuits 341 via the scanning signal lines G1 to G479 includes auxiliary circuits 351 corresponding to the signal output circuits 341 excluding the dummy circuits.

Figure 9:
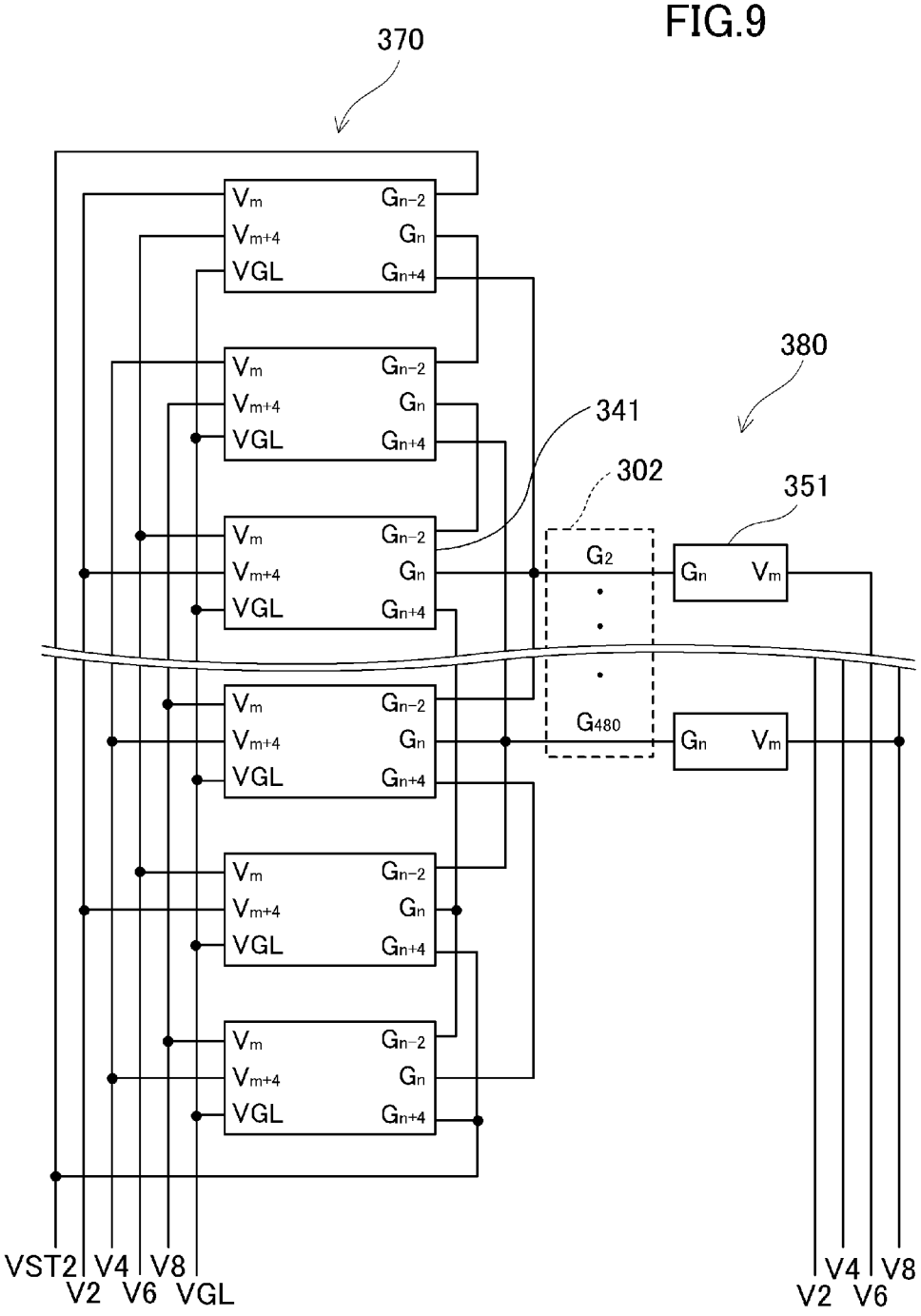
FIG. 9 is a diagram schematically illustrating the second driving circuit and the second auxiliary driving circuit shown in FIG. 7.

FIG. 9 schematically shows details of the second main driving circuit 370 and the second auxiliary driving circuit 380. A configuration of the second main driving circuit 370 and the second auxiliary driving circuit 380 is the same as that of the main driving circuit 240 and the auxiliary driving circuit 250 shown in FIG. 3 except that they correspond to only the even numbered scanning signal lines G2*i*. The second main driving circuit 370 includes a plurality of signal output circuits 341 in the same manner as FIG. 8, and each of the signal output circuits 341 has a single output terminal Gn. The output terminal Gn of the signal output circuit 341 is input to an input terminal Gn−2 of the next signal output circuit 341, and the signal output circuits 341 sequentially output a high level signal. In addition, the signal output circuits 341 in two stages from the top and the signal output circuits 341 in two stages from the bottom are dummy circuits, and are connected to input and output signal lines of the signal output circuits 341 which output signals to the upper scanning signal lines G2 and G4 and the lower scanning signal lines G478 and G480. In addition, the second auxiliary driving circuit 380 disposed at an opposite side to the signal output circuits 341 via the scanning signal lines G2 to G480 includes auxiliary circuits 351 corresponding to the signal output circuits 341 excluding the dummy circuits, in the same manner as FIG. 8.

Figure 10:
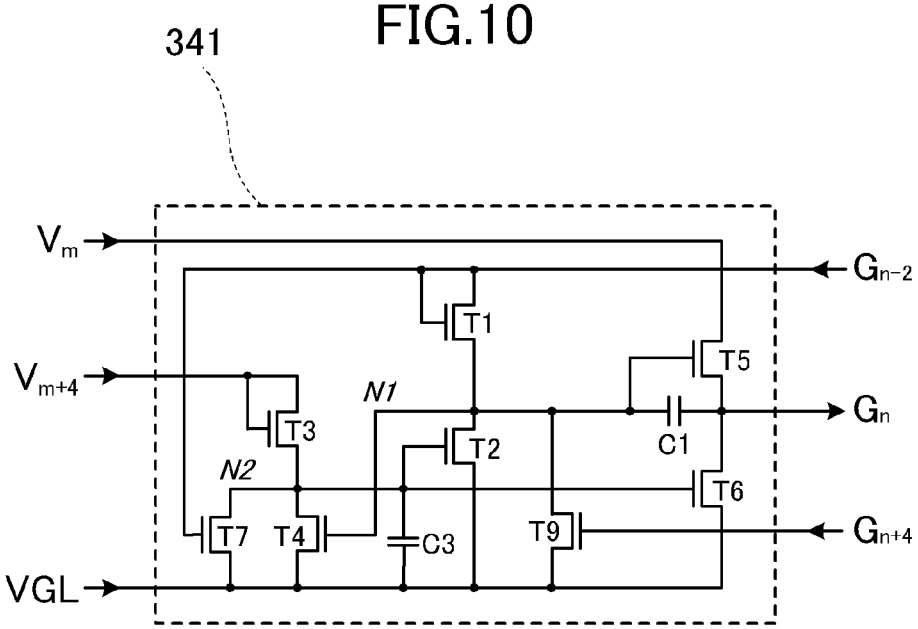
FIG. 10 is a diagram illustrating a circuit configuration of the signal output circuit shown in FIGS. 8 and 9.
Figure 11:
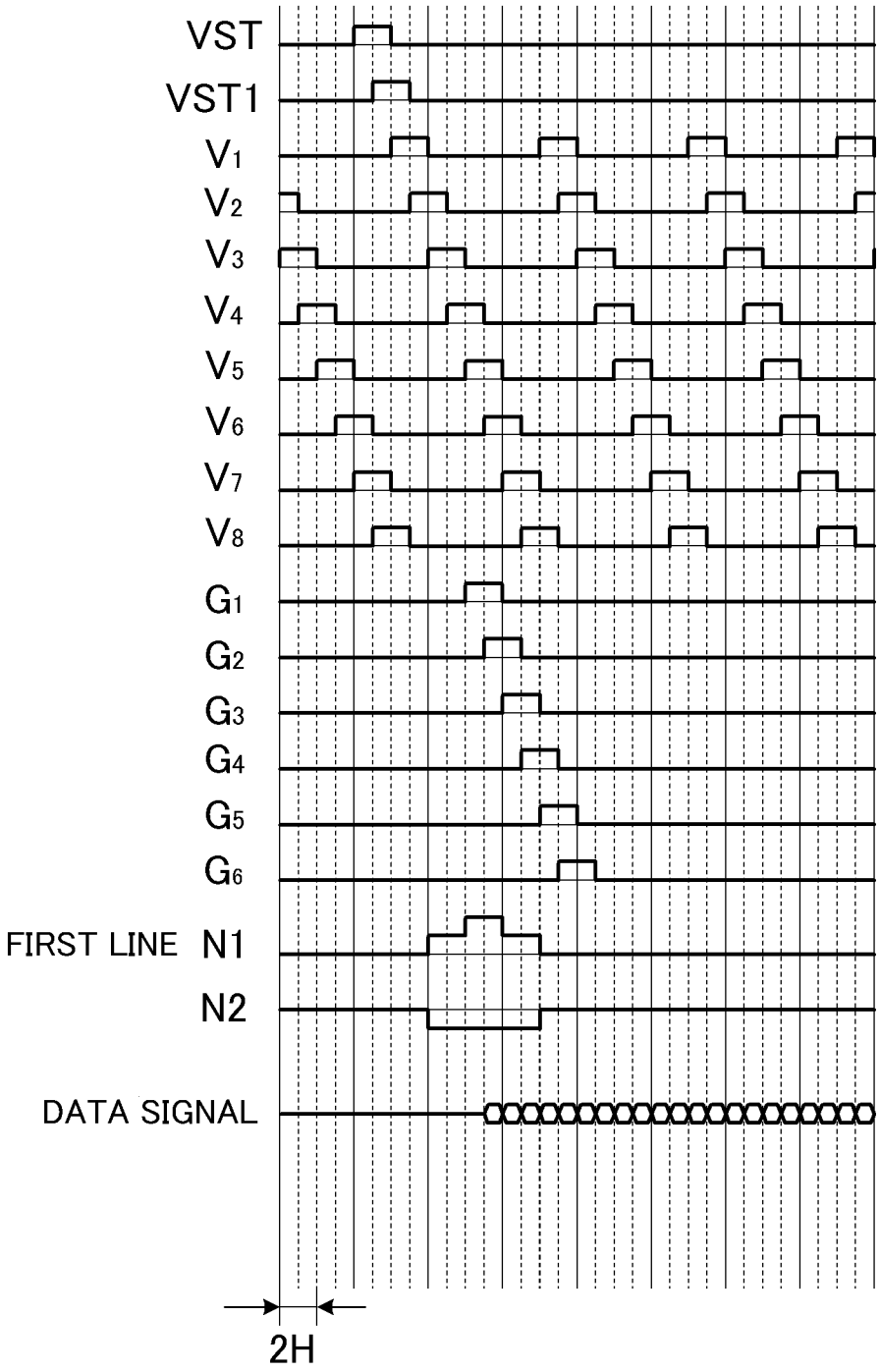
FIG. 11 is a timing chart for an operation of the signal output circuit shown in FIGS. 8 and 9.

FIG. 10 is a diagram illustrating a circuit configuration of the signal output circuit 341, and FIG. 11 is a timing chart for an operation of the signal output circuit 341 shown in FIG. 10. An operation of the signal output circuit 341 is obtained simply by changing the operation cycle of the signal output circuit 241 to 2H from 1H (H is a horizontal synchronization period) in the first embodiment, circuit configuration and operation are the same as each other, and thus description thereof will be omitted.

Figure 12:
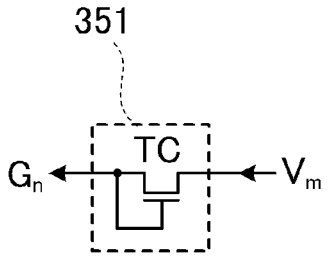
FIG. 12 is a diagram illustrating a circuit configuration of the auxiliary circuit shown in FIGS. 8 and 9.

FIG. 12 is a diagram illustrating a circuit configuration of the auxiliary circuit 351. A configuration of the auxiliary circuit 351 is the same as that of the auxiliary circuit 251 according to the first embodiment. That is to say, the auxiliary circuit 351 has a single transistor TC, a scanning signal line Gn is diode-connected to the transistor TC, and a line for a corresponding clock signal Vm is connected to the scanning signal line Gn. Thereby, in the second embodiment as well, in the auxiliary circuit 351, at a time when the scanning signal line Gn is changes from a high level to a low level in response to the clock signal Vm, the transistor TC is turned on due to a response delay when the scanning signal line Gn is at a high level even if the clock signal Vm is at a low level. Therefore, a current is leaked from the scanning signal line Gn in a high level to the line for the clock signal Vm in a low level, thus falling of the scanning signal line Gn becomes faster, and thereby waveform distortion can be improved. In addition, since a signal of the scanning signal line Gn input to the transistor TC is kept at a low level during entire period other than the output period, and since the clock signal Vm is an alternate current signal, it is possible to suppress shift of the threshold value voltage Vth caused by applying a high potential for a long time.

Therefore, it is possible to improve distortion of waveform output from the driving circuit of the liquid crystal display device, and thus display quality of the display device can be enhanced.

[Third Embodiment]

The third embodiment of the present invention will be described. A configuration of the liquid crystal display device according to the third embodiment is the same as the configuration according to the first embodiment shown in FIG. 1, and repeated description will be omitted.

Figure 13:
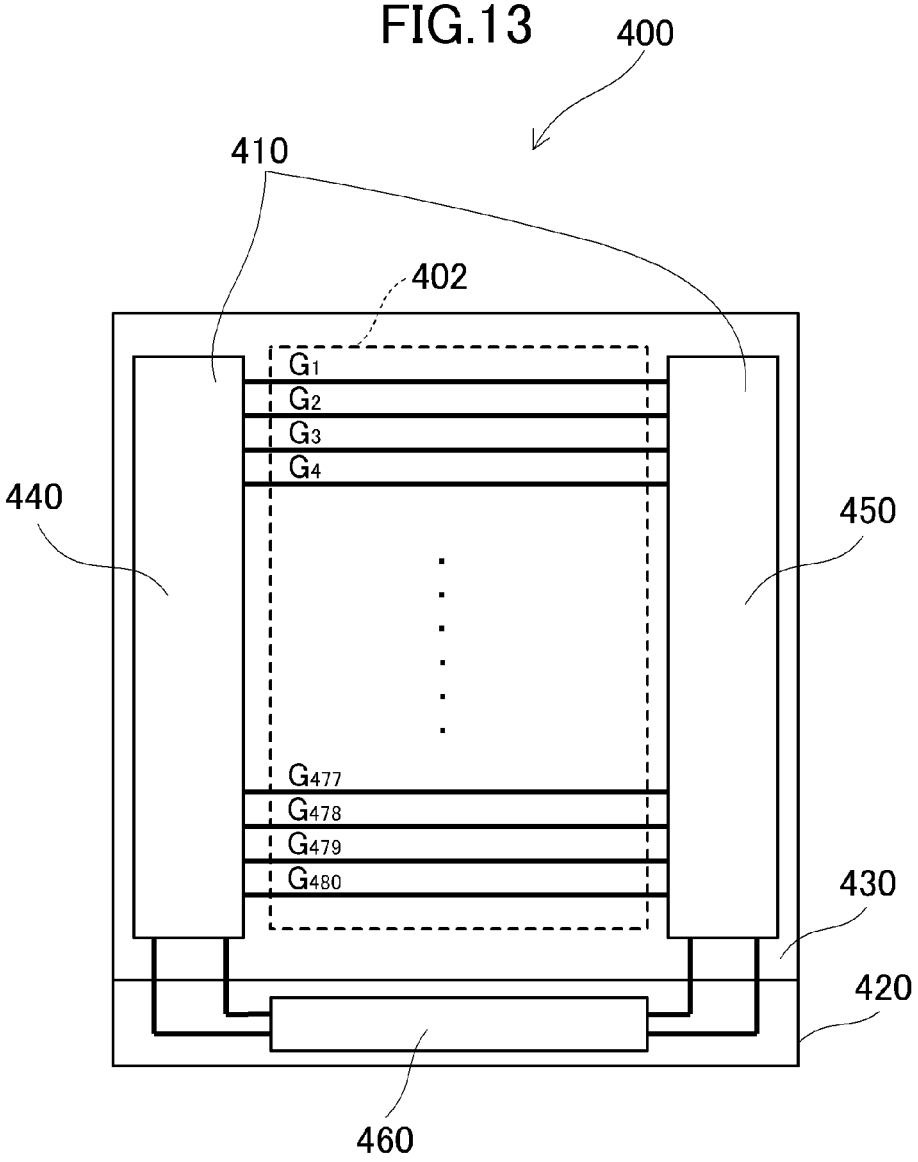
FIG. 13 is a diagram illustrating a liquid crystal panel of a liquid crystal display device according to a third embodiment.

FIG. 13 shows a liquid crystal panel 400 of the liquid crystal display device according to the third embodiment. The liquid crystal panel 400 includes two substrates of a TFT substrate 420 and a color filter substrate 430, and liquid crystal composition is sealed between the two substrates. The TFT substrate 420 includes a driving circuit 410 which sequentially applies predetermined voltages to scanning signal lines G1 to G480, and a driving IC 460 which applies voltages corresponding to grayscale values of pixels to a plurality of data signal lines (not shown) which extend so as to perpendicularly intersect the scanning signal lines G1 to G480 in a pixel region 402 and controls a first driving circuit with an auxiliary circuit 440 and a second driving circuit with an auxiliary circuit 450.

In addition, the driving circuit 410 includes the first driving circuit with an auxiliary circuit 440 which sequentially applies predetermined voltages to odd numbered scanning signal lines G2*i*-1 (where i is 1 to 240) and has an auxiliary circuit 443 (described later) which assists falling of even numbered scanning signal lines G2*i*, and the second driving circuit with an auxiliary circuit 450 which sequentially applies predetermined voltages to even numbered scanning signal lines G2*i* and has an auxiliary circuit 443 which assists falling of the odd numbered scanning signal lines G2*i*-1.

Figure 14A:
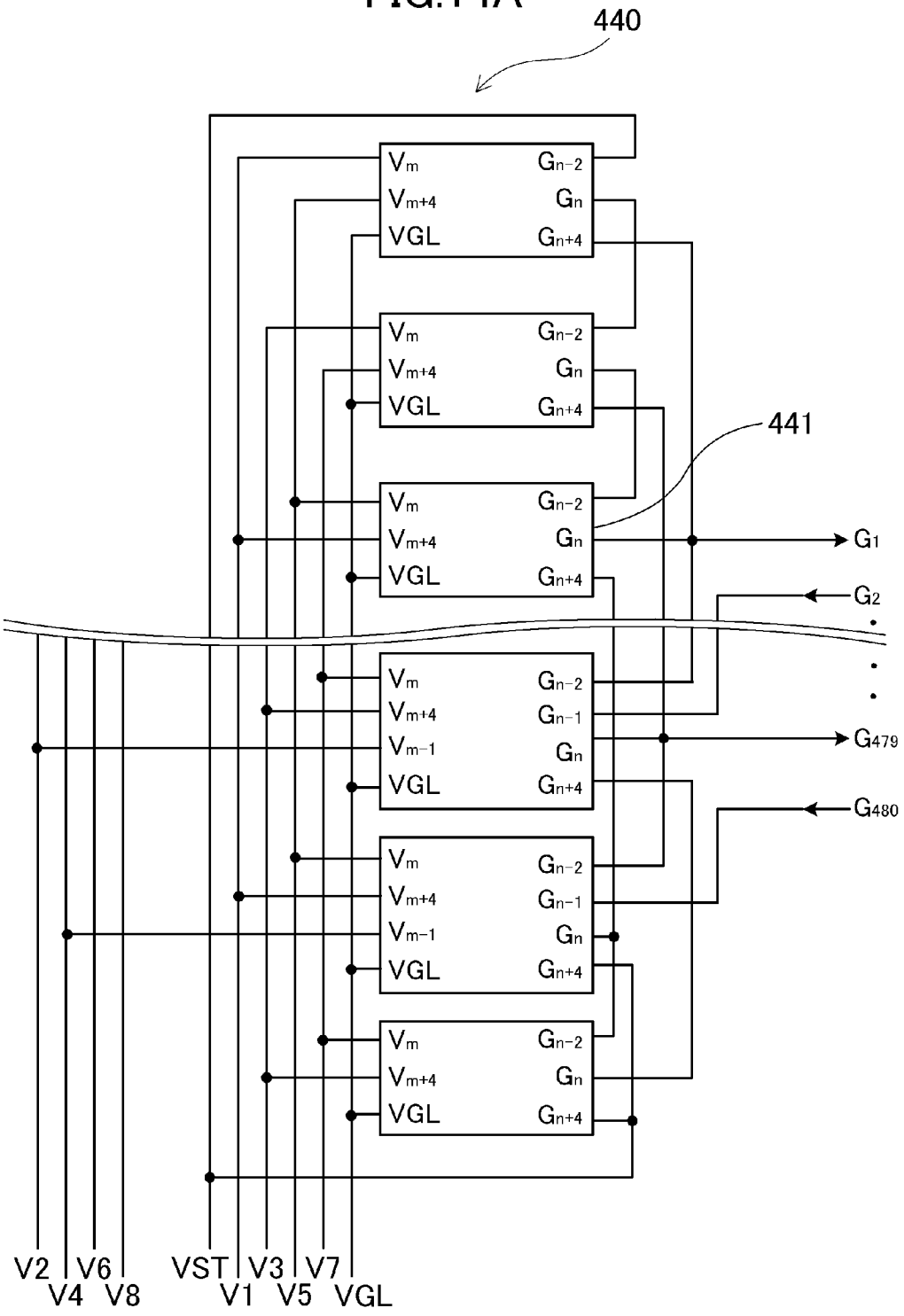
FIG. 14A is a diagram schematically illustrating the first driving circuit with an auxiliary circuit shown in FIG. 13.

FIG. 14A schematically shows details of the first driving circuit with an auxiliary circuit 440. The first driving circuit with an auxiliary circuit 440 includes a plurality of signal output circuits 441, and each of the signal output circuits 441 has a single output terminal Gn connected to one of the even numbered scanning signal lines G2*i*. The output terminal Gn of the signal output circuit 441 is input to an input terminal Gn−2 of the next signal output circuit 441, and the signal output circuits 441 sequentially output a high level signal. In addition, the signal output circuit 441 has a single input terminal Gn−1 connected to one of the odd numbered scanning signal lines G2*i*-1 and assists falling of a signal. The signal output circuits 441 in two stages from the top and the signal output circuits 441 in two stages from the bottom are dummy circuits.

Figure 14B:
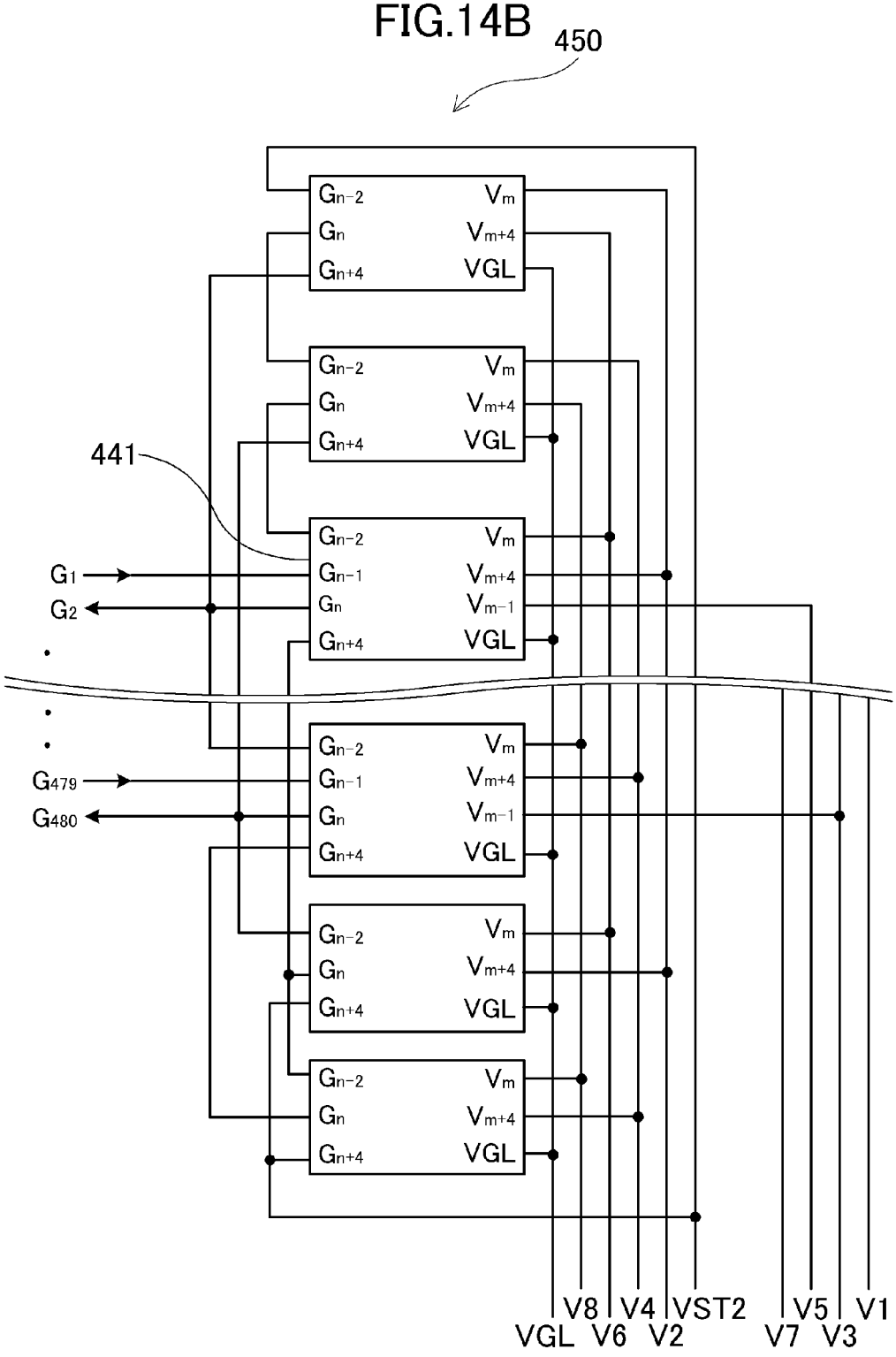
FIG. 14B is a diagram schematically illustrating the second driving circuit with an auxiliary circuit shown in FIG. 13.

FIG. 14B schematically shows details of the second driving circuit with an auxiliary circuit 450. In the same manner as the first driving circuit with an auxiliary circuit 440, a configuration of the second driving circuit with an auxiliary circuit 450 includes a plurality of signal output circuits 441, and the signal output circuit 441 is the same as the signal output circuit 441 of the first driving circuit with an auxiliary circuit 440 except that the output terminals change between the even numbered scanning signal lines G2*i* and the odd numbered scanning signal lines G2*i*-1.

Figure 15:
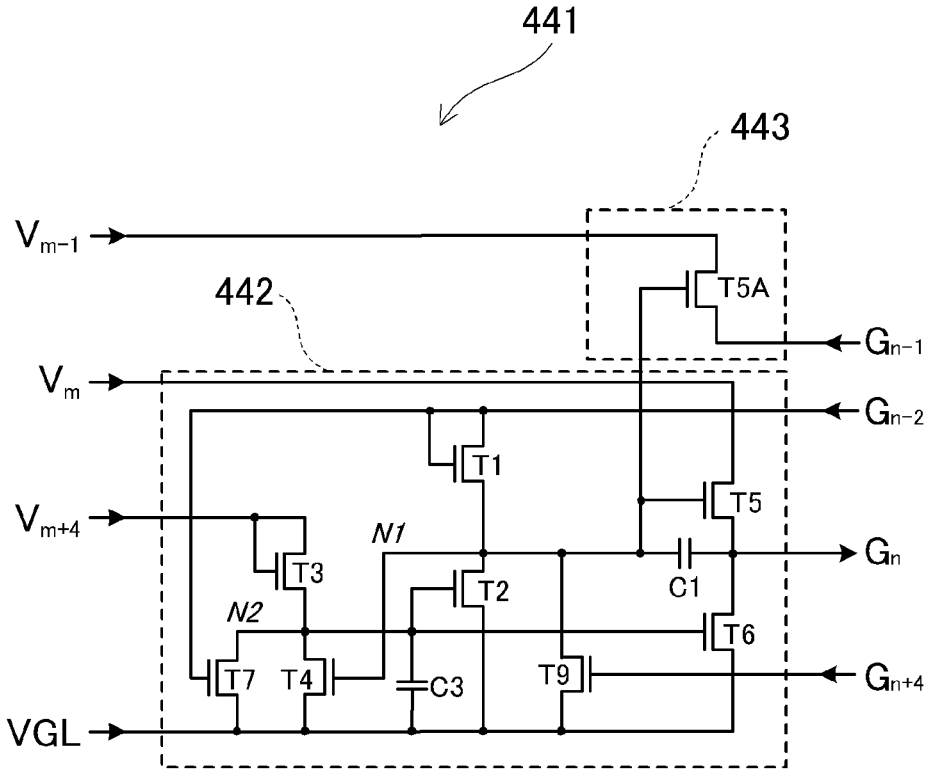
FIG. 15 is a diagram illustrating a circuit configuration of the signal output circuit shown in FIGS. 14A and 14B.
Figure 16:
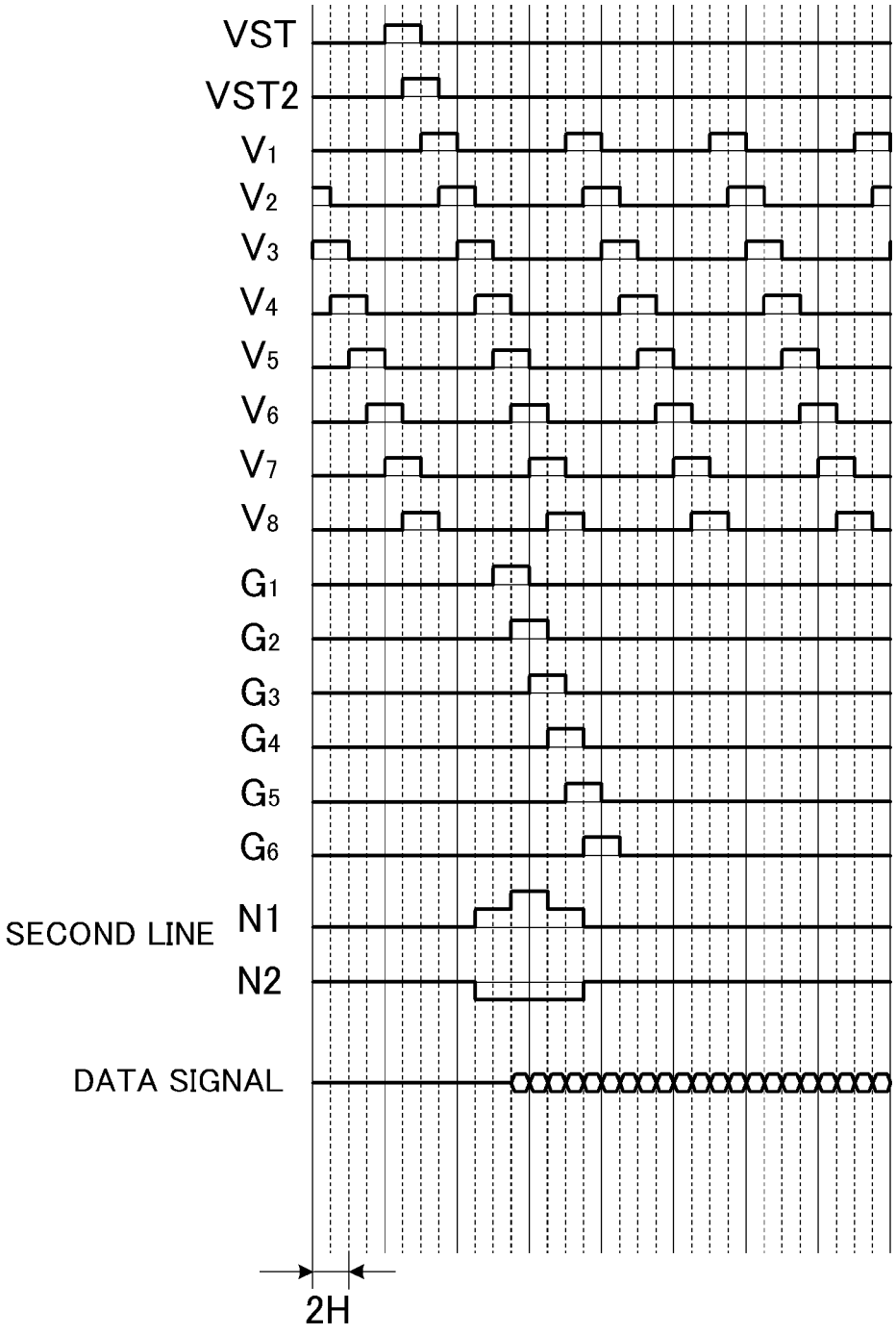
FIG. 16 is a timing chart for an operation of the signal output circuit shown in FIGS. 14A and 14B.

FIG. 15 is a diagram illustrating a circuit configuration of the signal output circuit 441, and FIG. 16 is a timing chart for an operation of the signal output circuit 441 shown in FIG. 15. The signal output circuit 441 is constituted by a main circuit 442 which is the same circuit as the signal output circuit 341 according to the second embodiment, and an auxiliary circuit 443, and has the same configuration except for the auxiliary circuit 443 and thus performs the same operation. The auxiliary circuit 443, as shown in FIG. 15, has a transistor T5A. A gate of the transistor T5A is connected to the node N1 of the main circuit 442, and a source and a drain thereof are respectively connected to a scanning signal line Gn−1, and a line for the clock signal Vm−1 which is used for output of the scanning signal line Gn−1 in the driving circuit located at an opposite side with respect to the display region.

Assuming the signal output circuit 441 which outputs a signal to the second scanning signal line, as shown in FIG. 16, the scanning signal line G2 is at a high level, the node N1 is also at a high level, the source and the drain of the transistor T5A are electrically connected to each other during falling and rising of the scanning signal line G2. Therefore, in the auxiliary circuit 443, the scanning signal line Gn−1 is connected to the line for the clock signal Vm−1 that is not delayed via the transistor T5A, and thus waveform distortion can be improved by current leaking from the line for the clock signal Vm−1 or current leaking to the line for the clock signal Vm−1. Particularly, at a timing where the scanning signal line Gn−1 is varied from a high level to a low level in response to the clock signal Vm−1, the node N1 has a charge-pumped high potential, and thus waveform distortion in falling of the scanning signal line Gn−1 can be further improved. In addition, since a signal of the node N1 input to the transistor T5A is kept at a low level during entire period other than the output period, and since the clock signal Vm−1 is an alternate current signal, it is possible to suppress shift of the threshold value voltage Vth caused by applying a high potential for a long time.

Therefore, it is possible to improve distortion of waveform output from the driving circuit of the liquid crystal display device, and thus display quality of the display device can be enhanced.

[Fourth Embodiment]

The fourth embodiment of the present invention will be described. A configuration of the liquid crystal display device according to the fourth embodiment is the same as the configuration according to the first embodiment shown in FIG. 1, and repeated description will be omitted.

Figure 17:
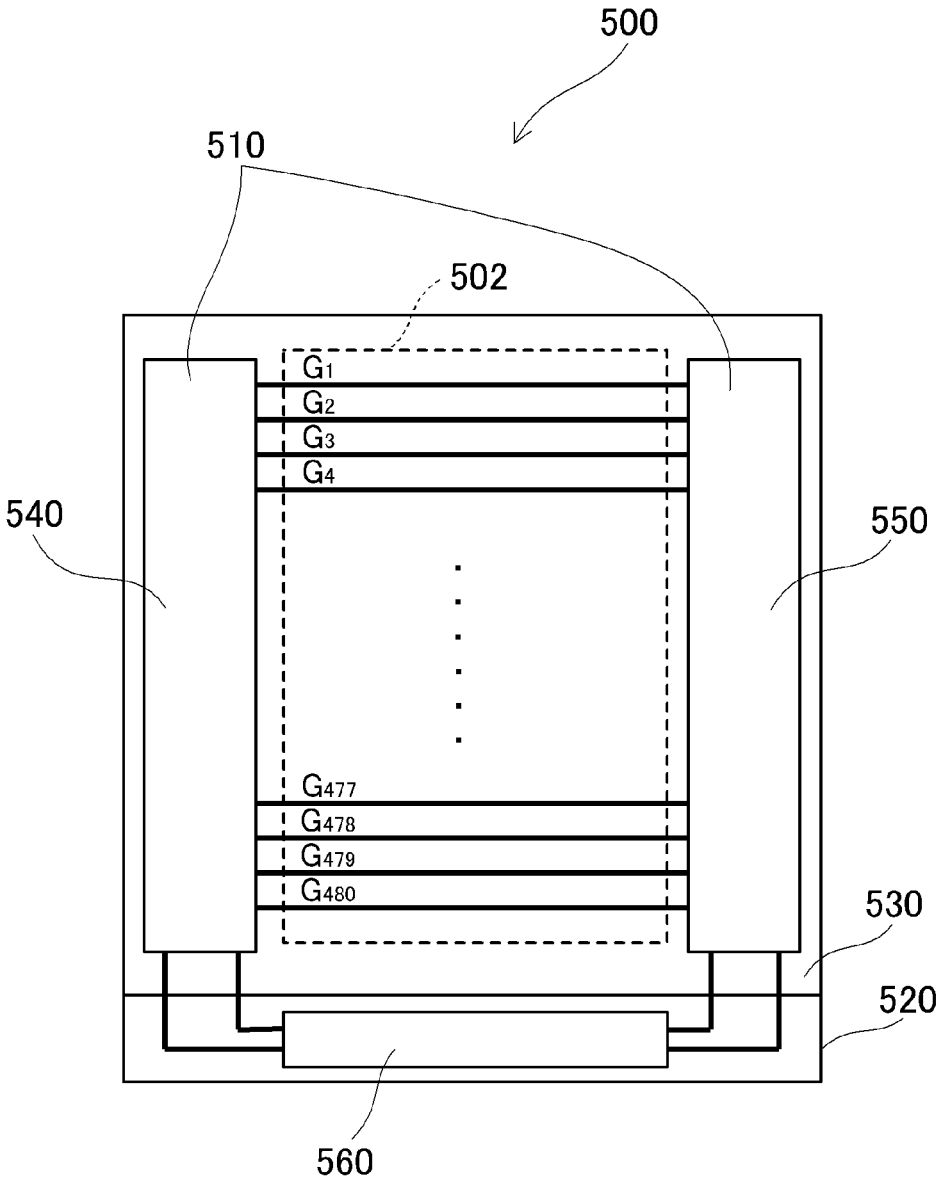
FIG. 17 is a diagram illustrating a liquid crystal panel of a liquid crystal display device according to a fourth embodiment.

FIG. 17 shows a liquid crystal panel 500 of the liquid crystal display device according to the fourth embodiment. The liquid crystal panel 500 includes two substrates of a TFT substrate 520 and a color filter substrate 530, and liquid crystal composition is sealed between the two substrates. The TFT substrate 520 includes a driving circuit 510 which sequentially applies predetermined voltages to scanning signal lines G1 to G480, and a driving IC 560 which applies voltages corresponding to grayscale values of pixels to a plurality of data signal lines (not shown) which extend so as to perpendicularly intersect the scanning signal lines G1 to G480 in a pixel region 502 and controls a first driving circuit with an auxiliary circuit 540 and a second driving circuit with an auxiliary circuit 550.

In addition, the driving circuit 510 includes the first driving circuit with an auxiliary circuit 540 which sequentially applies predetermined voltages to odd numbered scanning signal lines G2*i*-1 (where i is 1 to 240) and has an auxiliary circuit 543 (described later) which assists rising of even numbered scanning signal lines G2*i*, and the second driving circuit with an auxiliary circuit 550 which sequentially applies predetermined voltages to even numbered scanning signal lines G2*i* and has an auxiliary circuit 543 which assists rising of the odd numbered scanning signal lines G2*i*-1.

Figure 18A:
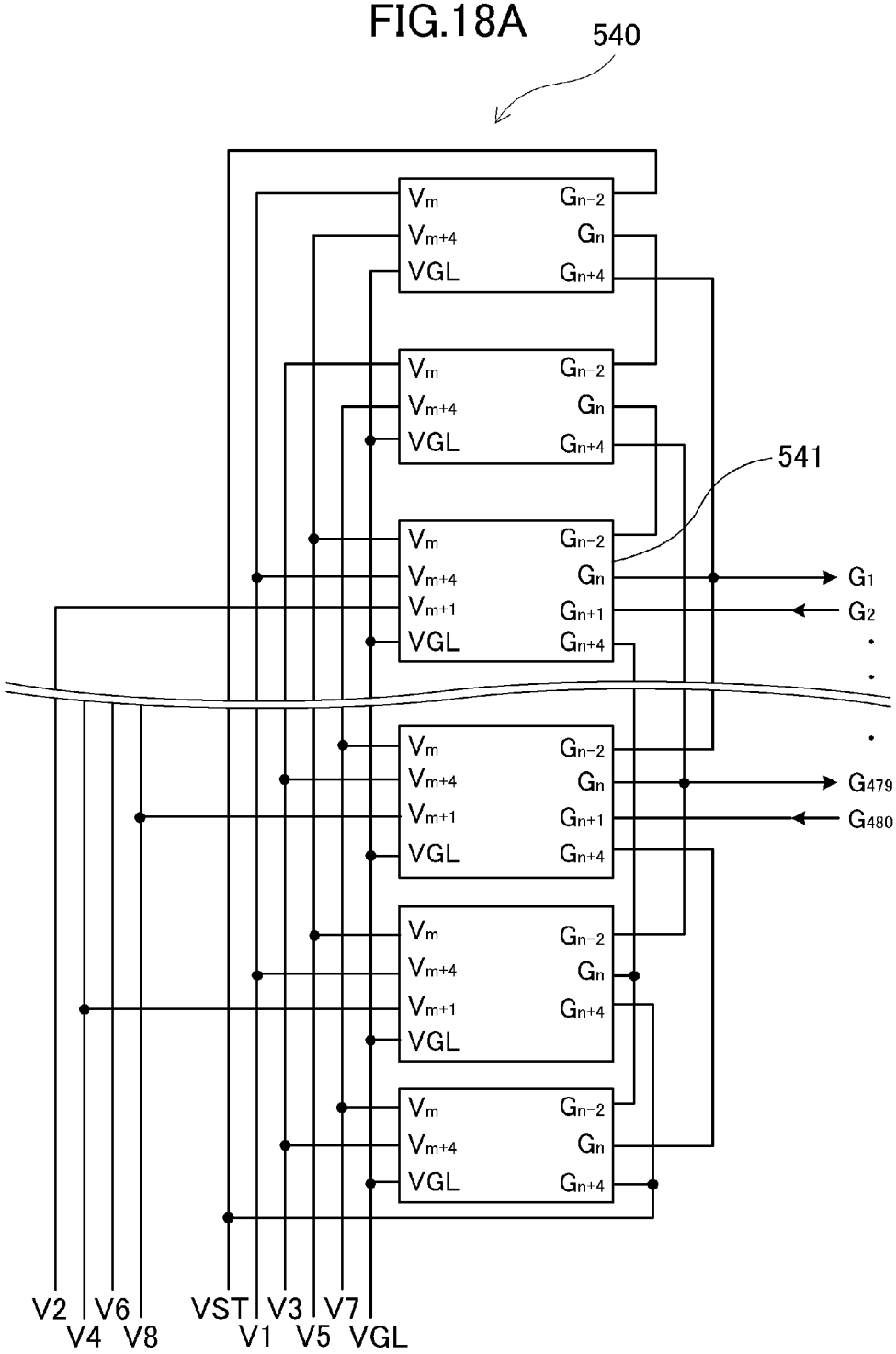
FIG. 18A is a diagram schematically illustrating the first driving circuit with an auxiliary circuit shown in FIG. 17.

FIG. 18A schematically shows details of the first driving circuit with an auxiliary circuit 540. As shown in FIG. 18A, the first driving circuit with an auxiliary circuit 540, in the same manner as the first driving circuit with an auxiliary circuit 440 according to the third embodiment, includes a plurality of signal output circuits 541, and each of the signal output circuits 541 has a single output terminal Gn connected to one of the odd numbered scanning signal lines G2*i*-1. The output terminal Gn of the signal output circuit 541 is input to an input terminal Gn−2 of the next signal output circuit 541, and the signal output circuits 541 sequentially output a high level signal. In addition, the signal output circuit 541 has a single input terminal Gn+1 connected to one of the even numbered scanning signal lines G2*i* and assists rising of a signal. The signal output circuits 541 in two stages from the top and the signal output circuits 541 in two stages from the bottom are dummy circuits.

Figure 18B:
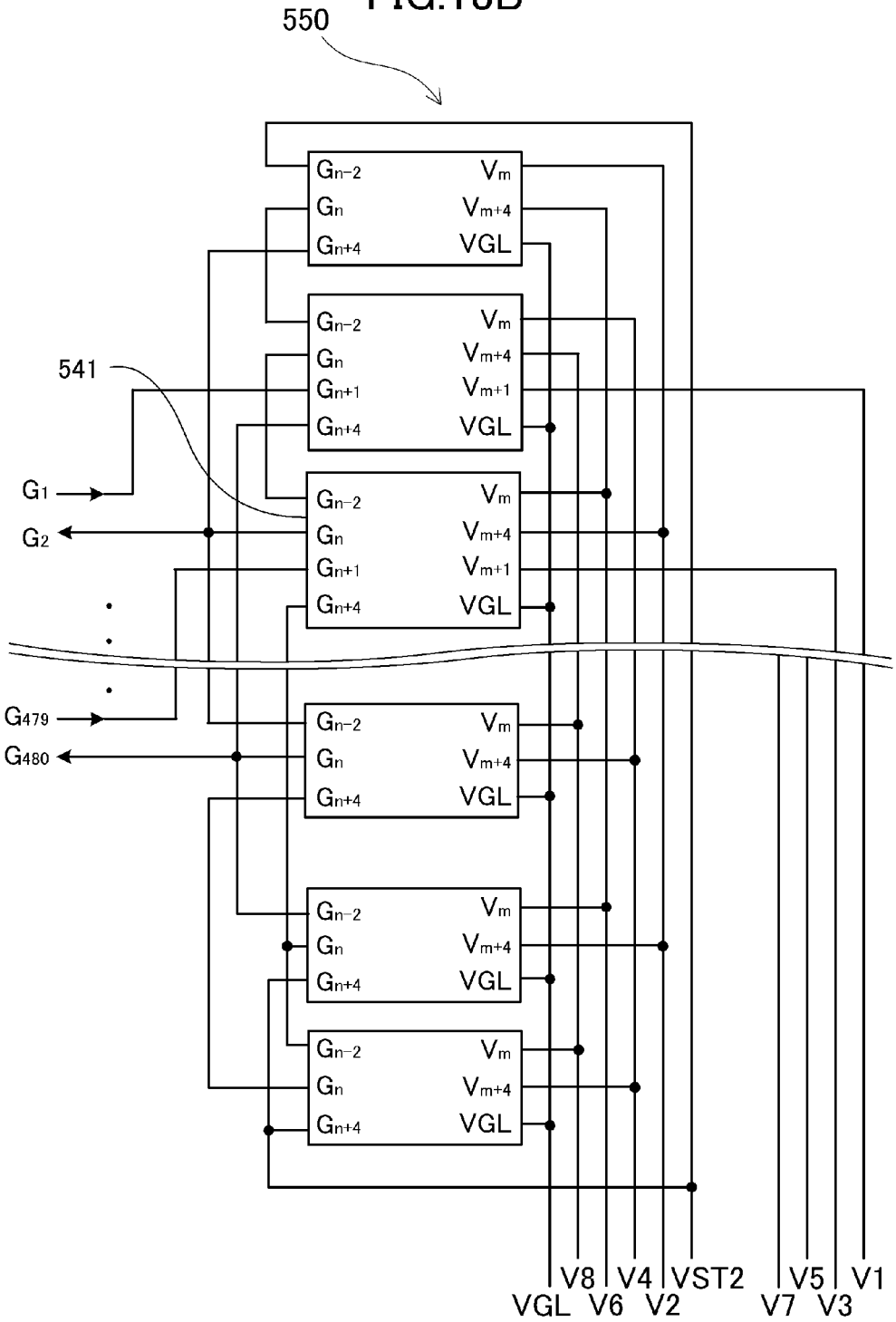
FIG. 18B is a diagram schematically illustrating the second driving circuit with an auxiliary circuit shown in FIG. 17.

FIG. 18B schematically shows details of the second driving circuit with an auxiliary circuit 550. In the same manner as the first driving circuit with an auxiliary circuit 540, a configuration of the second driving circuit with an auxiliary circuit 550 includes a plurality of signal output circuits 541, and the signal output circuit 541 is the same as the signal output circuit 541 of the first driving circuit with an auxiliary circuit 540 except that the output terminals change between the even numbered scanning signal lines G2*i* and the odd numbered scanning signal lines G2*i*-1.

Figure 19:
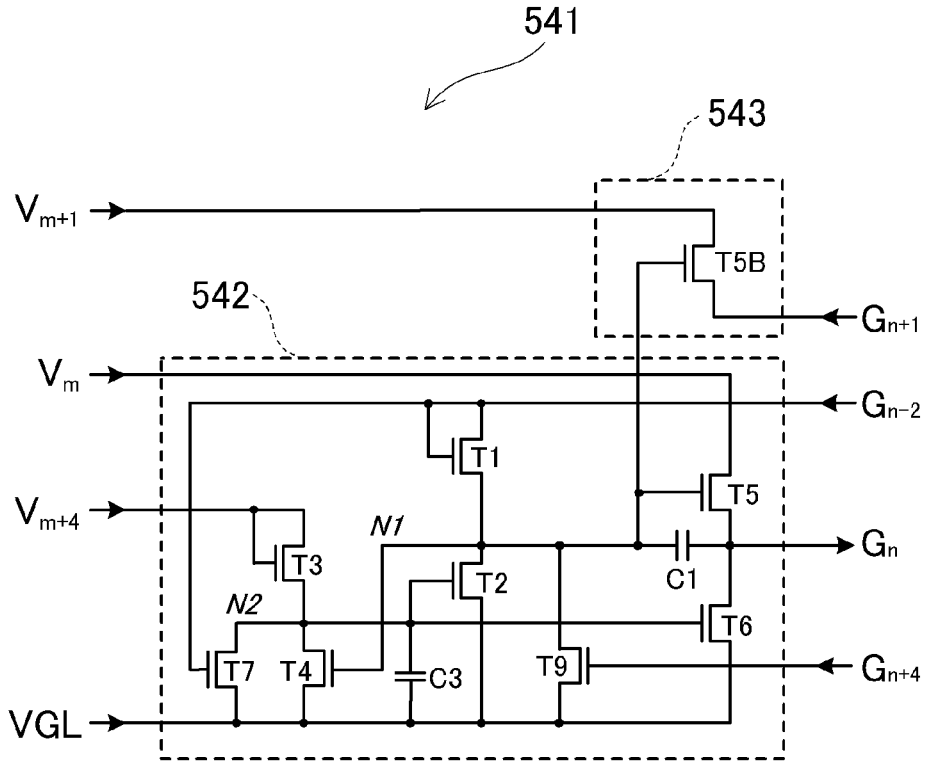
FIG. 19 is a diagram illustrating a circuit configuration of the signal output circuit shown in FIGS. 18A and 18B.
Figure 20:
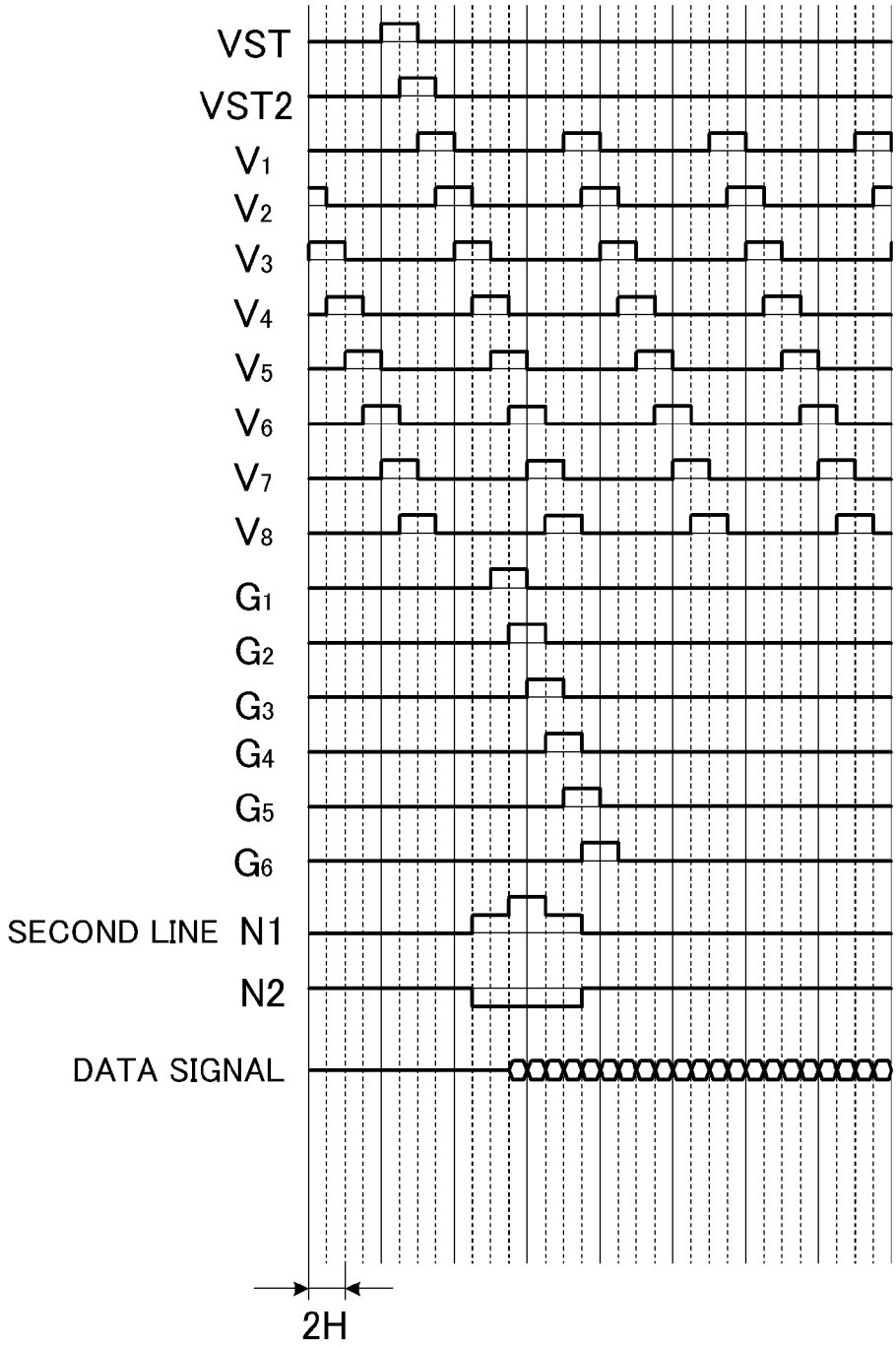
FIG. 20 is a timing chart for an operation of the signal output circuit shown in FIGS. 18A and 18B.

FIG. 19 is a diagram illustrating a circuit configuration of the signal output circuit 541, and FIG. 20 is a timing chart for an operation of the signal output circuit 541 shown in FIG. 19. The signal output circuit 541 is constituted by a main circuit 542 and an auxiliary circuit 543, in the same manner as the signal output circuit 441 according to the third embodiment, and has the same configuration except that the source and the drain of the transistor T5B of the auxiliary circuit 543 are connected to the scanning signal line Gn+1 and a line for the clock signal Vm+1.

Here, assuming the signal output circuit 541 which outputs a signal to the second scanning signal line, as shown in FIG. 20, the scanning signal line G2 is at a high level, the node N1 is also at a high level, the source and the drain of the transistor T5B are electrically connected to each other during falling and rising of the scanning signal line G2 in the same manner as the third embodiment. Therefore, in the auxiliary circuit 543, the scanning signal line Gn+1 is connected to the line for the clock signal Vm+1 that is not delayed via the transistor T5B, and thus waveform distortion can be improved by current leaking. Particularly, at a timing where the scanning signal line Gn+1 is varied from a low level to a high level in response to the clock signal Vm+1, the node N1 has a charge-pumped high potential, and thus waveform distortion in rising of the scanning signal line Gn+1 can be further improved. In addition, since a signal of the node N1 input to the transistor T5B is at a low level during entire period other than the output period, and since the clock signal Vm+1 is an alternate current signal, it is possible to suppress shift of the threshold value voltage Vth caused by applying a high potential for a long time.

Therefore, it is possible to improve distortion of waveform output from the driving circuit of the liquid crystal display device, and thus display quality of the display device can be enhanced.

In addition, although an NMOS type transistor, in which the source and the drain are electrically connected to each other when as an active signal a high level signal is input to a gate thereof, is used in the above-described embodiments, a PMOS type transistor, in which a source and a drain are electrically connected to each other when as an active signal a low level signal is input to a gate thereof may also be used.

In addition, the present invention is applicable to any type of liquid crystal display device such as an IPS (In-Plane Switching) type, a VA (Vertically Aligned) type, and a TN (Twisted Nematic) type. The present invention is not limited to the liquid crystal display device, and is applicable to an organic EL display device, a field emission display device (FED), and other display devices using a shift register as a driving circuit.

While there have been described what are at present considered to be certain embodiments of the invention, it will be understood that various modifications may be made thereto, and it is intended that the appended claim cover all such modifications as fall within the true spirit and scope of the invention.

What is claimed is:

1. A display device comprising a driving circuit configured to sequentially apply an active potential, which comprises a potential for turning on pixel transistors of the display device, to a plurality of output signal lines extending from an upper output signal line to a lower output signal line, wherein the driving circuit includes a main driving circuit configured to output the active potential to one end of one of the output signal lines of the plurality of output signal lines by applying a first clock signal caused by an input of the active potential output from the upper output signal line; and an auxiliary driving circuit that includes an auxiliary transistor comprising a transistor in which one of a source and a drain is connected to the other end of said one output signal line, and the other of said source and drain is connected to a signal line for said first clock signal, wherein the main driving circuit includes a main transistor that is switched so as to apply the first clock signal to the output signal line, and a gate of the auxiliary transistor is connected to a gate line of the main transistor for the upper output signal line.

2. The display device according to claim 1, wherein said one output signal line is connected to either the source or the drain and a gate of the auxiliary transistor.

3. A display device comprising a driving circuit configured to sequentially apply an active potential, which comprises a potential for turning on pixel transistors of the display device, to a plurality of output signal lines extending from an upper output signal line to a lower output signal line, wherein the driving circuit includes a main driving circuit configured to output the active potential to one end of one of the output signal lines of the plurality of output signal lines by applying a first clock signal caused by an input of the active potential output from the upper output signal line; and an auxiliary driving circuit that includes an auxiliary transistor comprising a transistor in which one of a source and a drain is connected to the other end of said one output signal line, and the other of said source and drain is connected to a signal line for said first clock signal, wherein the main driving circuit includes a main transistor that is switched so as to apply the clock signal to the output signal line, and wherein a gate of the auxiliary transistor is connected to a gate line of the main transistor for the lower output signal line.

4. A display device comprising:

a plurality of pixels including pixel transistor;

a plurality of gate signal lines electrically connected with a gate electrode of the pixel transistor;

a gate signal line driving circuit for outputting a scanning signal to the plurality of gate signal lines;

wherein the gate signal line driving circuit includes a main driving circuit and a support circuit, the main driving circuit is configured to output a clock signal as the scanning signal to one end of the gate signal line, the support circuit electrically connects between the clock signal and the other end of the gate signal line.

5. The display device according to claim 4, wherein the main driving circuit is configured to apply a HIGH voltage to a gate signal line during a signal HIGH period by applying the clock signal.

6. The display device according to claim 4, wherein the main driving circuit includes a HIGH voltage applying transistor which is configured to apply the clock signal as a HIGH voltage to the gate signal line.

7. The display device according to claim 4, wherein the main driving circuit includes a HIGH voltage applying transistor which is configured to apply a HIGH voltage to the gate signal line by connecting between the gate signal line and the clock signal.

8. The display device according to claim 4, wherein the main driving circuit includes a HIGH voltage applying transistor, wherein the HIGH voltage applying transistor includes a control terminal, an input terminal and an output terminal, the control terminal electrically connects with a first node, the input terminal electrically connects with a clock signal line which supplies the clock signal, the output terminal electrically connects with the gate signal line, wherein the clock signal is supplied through the HIGH voltage applying transistor from the clock signal line to the gate signal line when a high voltage is applied to the first node.

9. A display device comprising a driving circuit configured to sequentially apply an active potential, which comprises a potential for turning on pixel transistors of the display device, to a plurality of output signal lines extending from an upper output signal line to a lower output signal line, wherein the driving circuit includes a main driving circuit configured to output the active potential to one end of one of the output signal lines of the plurality of output signal lines by applying a first clock signal caused by an input of the active potential output from the upper output signal line;

an auxiliary driving circuit that includes an auxiliary transistor comprising a transistor in which one of a source and a drain is connected to the other end of said one output signal line, and the other of said source and drain is connected to a signal line for said first clock signal, wherein the main driving circuit includes a main transistor that is switched so as to apply the clock signal to the output signal line, and wherein a gate of the auxiliary transistor is connected to one of a gate line of the main transistor for the upper output signal line and a gate line of the main transistor for the lower output signal line.

* * * * *